US012416169B2

(12) United States Patent
Benz et al.

(10) Patent No.: US 12,416,169 B2
(45) Date of Patent: Sep. 16, 2025

(54) FRAME WITH A BOOM PEDESTAL FOR MOUNTING A THICK MATTER DISTRIBUTION BOOM

(71) Applicant: Putzmeister Engineering GmbH, Aichtal (DE)

(72) Inventors: Andreas Benz, Aichtal (DE); Dietmar Fügel, Aichtal (DE); Matthias Braun, Aichtal (DE); Benedikt Pawisa, Aichtal (DE)

(73) Assignee: Putzmeister Engineering GmbH, Aichtal (DE)

( * ) Notice: Subject to any disclaimer, the term of this patent is extended or adjusted under 35 U.S.C. 154(b) by 191 days.

(21) Appl. No.: 18/258,110

(22) PCT Filed: Nov. 19, 2021

(86) PCT No.: PCT/EP2021/082258
§ 371 (c)(1),
(2) Date: Jun. 16, 2023

(87) PCT Pub. No.: WO2022/128326
PCT Pub. Date: Jun. 23, 2022

(65) Prior Publication Data

US 2024/0102299 A1 Mar. 28, 2024

(30) Foreign Application Priority Data

Dec. 17, 2020 (DE) ..... 102020134024.9

(51) Int. Cl.
*E04G 21/04* (2006.01)

(52) U.S. Cl.
CPC ..... *E04G 21/0445* (2013.01); *E04G 21/0436* (2013.01)

(58) Field of Classification Search
CPC ..... Y10T 137/6855; E04G 21/0445; E04G 21/0436
See application file for complete search history.

(56) References Cited

U.S. PATENT DOCUMENTS 4,430,028 A * 2/1984 Clayton ..... B60P 3/224 406/166
4,457,338 A * 7/1984 Moller ..... F16L 27/0861 137/899

(Continued)

FOREIGN PATENT DOCUMENTS

CN 201424817 3/2010
CN 103192882 B 1/2016

(Continued)

OTHER PUBLICATIONS

PCT International Search Report and Written Opinion for International Application No. PCT/EP2021/082258 filed on Nov. 19, 2021, Date of Mailing: Feb. 24, 2022; 12 pgs.

(Continued)

*Primary Examiner* — Craig M Schneider
(74) *Attorney, Agent, or Firm* — Alix, Yale & Ristas, LLP

(57) ABSTRACT

The subject of the present invention is a frame (12) with a boom pedestal (17) for mounting a thick matter distribution boom (20) and having a support profile (13) for receiving and transmitting a force flow generated by the weight force of the thick matter distribution boom (20). The boom pedestal (17) has two tab elements (21, 22) which project downwards from the boom pedestal (17) and which each have a through-hole (23, 24), wherein the support profile (13) comprises a bolt receptacle (14) aligned with the through-holes, and wherein a bolt element (15) for connecting the boom pedestal (17) to the support profile (13) is guided through the through-holes (23, 24) and the bolt (Continued)

receptacle (14). The invention further relates to a corresponding thick matter pump equipped with said frame. The transportation effort required in production can be reduced by means of the bolt connection.

18 Claims, 8 Drawing Sheets

(56) References Cited

U.S. PATENT DOCUMENTS

| | | | | |
|---|---|---|---|---|
| 4,828,033 | A * | 5/1989 | Frison | B67D 7/002 166/292 |
| 5,810,051 | A * | 9/1998 | Campagna | E03B 9/00 251/59 |
| 6,257,272 | B1 * | 7/2001 | Keiser | B60P 3/22 137/899 |
| 6,588,448 | B1 * | 7/2003 | Raymond | E04G 21/04 222/608 |
| 7,328,810 | B1 * | 2/2008 | Rhodes | B66C 23/80 212/304 |
| 7,971,534 | B2 * | 7/2011 | Waldock | B60P 3/2205 86/20.15 |
| 11,384,549 | B2 * | 7/2022 | Benz | E04G 21/0436 |
| 2008/0083143 | A1 * | 4/2008 | Maybury | E02F 3/8891 37/317 |
| 2015/0056084 | A1 * | 2/2015 | Fuegel | E04G 21/0445 417/234 |
| 2017/0051520 | A1 | 2/2017 | Fügel et al. | |
| 2021/0087838 | A1 * | 3/2021 | Benz | E04G 21/0436 |

FOREIGN PATENT DOCUMENTS

| | | | |
|---|---|---|---|
| DE | 2633334 | | 2/1978 |
| DE | 3101893 | | 8/1982 |
| DE | 102014211992 | A1 | 12/2015 |
| DE | 102014211999 | | 12/2015 |
| DE | 202016106682 | | 3/2017 |
| EP | 3369876 | | 9/2018 |
| EP | 3656947 | A1 | 5/2020 |
| JP | S664032978 | A | 2/1989 |
| JP | 2017515022 | A | 6/2017 |
| WO | 2016023758 | A1 | 2/2016 |

OTHER PUBLICATIONS

PCT International Preliminary Report on Patentability and Written Opinion for International Application No. PCT/EP2021/082258 filed on Nov. 19, 2021, Date of Mailing: Jun. 29, 2023; 7 pgs.

English Translation of PCT International Preliminary Report on Patentability and Written Opinion for International Application No. PCT/EP2021/082258 filed on Nov. 19, 2021, Date of Mailing: Jun. 29, 2023; 7 pgs.

Japanese Office Action for Patent Application No. P2023-536440; Dispatch Date: Apr. 1, 2025; 10 pgs.

* cited by examiner

"A"

FRAME WITH A BOOM PEDESTAL FOR MOUNTING A THICK MATTER DISTRIBUTION BOOM

BACKGROUND

The present invention relates to a frame with a boom pedestal fastened thereto for mounting a thick matter distribution boom.

For discharging concrete by means of mobile or stationary concrete pumps, use is regularly made of a thick matter distribution boom which is carried by a frame. For this purpose, what is referred to as a boom pedestal is fixed to the frame, and the thick matter distribution boom can be mounted on said boom pedestal so as to be rotated about a vertical axis. The thick matter distribution boom can be constructed from a plurality of boom segments which can be pivoted relative to one another in order to reach a desired discharge location. The concrete which is pressurized by a pumping device can be discharged at a desired location via a concrete delivery line guided along the thick matter distribution boom. Frames of the abovementioned type can also be used in truck mixers, the frame in this case additionally being designed to carry a mixing drum.

In particular in an extended state of the boom segments, large load torques arise which have to be introduced into the frame via the boom pedestal and dissipated from the frame into the underlying surface. For this purpose, the frame can have, for example, two carrier profiles which are oriented in the longitudinal direction of the frame and serve for transmitting a force flow. It is conventional in the prior art to weld the boom pedestal to the carrier profiles. However, the welding work required for this purpose is complex. After the welded joint has been produced, the carrier profiles can be transported only together with the boom pedestal which is fastened thereto, this resulting in a high outlay on transport and making the production process inflexible.

SUMMARY

Starting from this prior art, it is the object of the present invention to supply a frame with a boom pedestal fastened thereto for mounting a thick material distribution boom, and a mobile thick material pump which is equipped with a corresponding frame, said frame and thick material pump at least partially avoiding the aforementioned disadvantages. This object is achieved by the features of the independent claims. Advantageous embodiments are described in the dependent claims.

The frame according to the invention comprises a boom pedestal for mounting a thick matter distribution boom and a carrier profile for receiving and transmitting a force flow generated by the weight force of the thick material distribution boom. The boom pedestal has two tab elements which project downward from the boom pedestal and each have a through hole, wherein the carrier profile comprises a bolt receptacle aligned with the through holes. A bolt element for connecting the boom pedestal to the carrier profile is guided through the through holes and the bolt receptacle.

First of all, some terms used within the scope of the present description will be explained. The frame according to the invention has at least one and preferably two carrier profiles which can be oriented, for example, parallel to one another. Each of the carrier profiles is preferably assigned two tab elements. For the sake of simplicity, at many points within the scope of the present description, only the configuration of one individual carrier profile which interacts with two tab elements will be explained. It goes without saying that the frame according to the invention can also have two or more carrier profiles which can each have further features explained within the scope of the present description. The carrier profile conventionally has a longitudinal direction along which the force flow generated by the thick matter distribution boom is conducted. This longitudinal direction can coincide with the longitudinal direction of the frame.

The carrier profile is designed for receiving and transmitting the force flow. In particular, provision can be made that a substantial part of the force flow generated by the thick material distribution boom is transmitted along the carrier profiles to a force dissipation region spaced apart from the boom pedestal. The force dissipation region can be arranged in particular at one longitudinal end of the carrier profile. In the force dissipation region there can be a supporting system which is connected to the carrier profile and is designed for introducing the forces, which are transmitted by the carrier profile, into the underlying surface. The frame differs to this extent from support structures in which the force flow from the boom pedestal is introduced directly into a carrying structure formed from support leg boxes and into support legs which are connected to said carrying structure and are extendable or can be pivoted out (see, for example, EP 3 369 876 A1). In particular, rear support legs are not absolutely necessary in the present frame since the carrier profile together with a supporting system connected thereto already takes on a corresponding rearward supporting function. Since rearward support legs after being extended or pivoted out take up a large amount of space during use, the space required by the present frame is correspondingly reduced. In addition, more storage space is available on the loading surface located above the frame because of the absence of the rear support legs.

Within the scope of the invention, it has been recognized that the boom pedestal can be releasably connected to the carrier profile in a secure and at the same time flexible way by means of a bolt connection. It has been shown that sufficient introduction of force into the carrier profiles can be realized by the tab elements provided on the boom pedestal. The production of a frame according to the invention can thereby be configured significantly more flexibly. In particular, the connection between the carrier profiles and the boom pedestal is significantly simplified since no complex welding work is required. The carrier profiles can be correspondingly transported significantly more flexibly separately from the boom pedestal, with it being possible for the boom pedestal to be connected to the carrier profiles only at or in the vicinity of a use location. This can be undertaken in a simple manner in that the boom pedestal is placed onto the carrier profiles such that the through holes of the tab elements are brought into alignment with a corresponding bolt receptacle, and the orientation of the through holes of the tab elements corresponds to the orientation of the bolt receptacle. A bolt element can be subsequently plugged into the bolt receptacle and into the through holes of the tab elements.

The tab element can be in the form of a sheet metal part. The sheet metal part is preferably oriented substantially parallel to a side surface of the carrier profile. The force flow transmission of the forces exerted by the thick material distribution boom can thus take place efficiently along the surface of the sheet metal part and into the carrier profile side surface which is oriented approximately parallel thereto.

In one embodiment, the tab element is oriented substantially along the longitudinal direction of the carrier profile. It has been shown that this configuration is advantageous for the force flow transmission since no directional changes are required for transmitting the forces in the longitudinal direction of the carrier profile.

The tab elements can engage laterally around the carrier profile in the transverse direction. In this configuration, the carrier profile is located between the tab elements, as a result of which a force distribution, which is symmetrical with respect to the longitudinal axis, to the carrier profile can be achieved.

The carrier profile can be in the form of a hollow profile with a first side wall and with a second side wall. Preferably, one of the tab elements is oriented substantially parallel to the first side wall, wherein furthermore preferably the other of the tab elements is oriented parallel to the second side wall of the hollow profile. If the carrier profile is in the form of a hollow profile, the forces exerted by the thick material distribution boom can be introduced particularly effectively into the side walls of the hollow profile and transmitted via the side walls.

The tab element can be connected to the boom pedestal by means of a joining connection. In particular, the joining connection can be designed as a welded joint. Since, during the production of the boom pedestal, welded joints are conventionally required in any case, the additional production of a welded joint between the tab elements and the boom pedestal constitutes only a small additional outlay.

The boom pedestal can have at least one side surface portion, wherein at least part of the joining connection can extend along the side surface portion. In addition, the boom pedestal can have a base surface portion, wherein at least part of the joining connection can extend along the base surface portion. The side surface portion and/or the base surface portion can be flat. The abovementioned features reduce the outlay on production, and also the stability of the connection and the suitability for transmitting large force flows are improved. The boom pedestal can be formed, for example, from a plurality of bent or joined-together sheet metal parts, wherein the side surface portion and/or the base surface portion can be formed by one of the sheet metal parts.

In one embodiment, a cylinder sleeve is inserted into the bolt receptacle, the inner surface of which cylinder sleeve corresponds to an outer surface of the bolt element. The stability of the bolt connection can be significantly increased by the cylinder sleeve. The cylinder sleeve can be fixedly connected to the carrier profile by a joining connection. In particular, the cylinder sleeve can be welded to the carrier profile.

The cylinder sleeve can furthermore have an end-side collar which projects outward from the cylinder surface and is designed to bear against an inner surface or outer surface of the carrier profile. Such a collar makes it possible to determine a defined position relative to the carrier profile along the axial direction of the cylinder sleeve. In addition, the collar can serve as a weld pool retention device if the cylinder sleeve is welded to the carrier profile. In addition, the cylinder sleeve can have a portion projecting beyond the carrier profile in the axial direction of the bolt receptacle. Said portion can facilitate the production of a stable welded joint.

The carrier profile preferably has at least two profiled sheets which are each bent along at least one bending axis and are assembled along at least two connecting lines to form a hollow profile, wherein preferably the connecting lines and/or the bending axes are oriented parallel to the longitudinal direction of the carrier profile.

It has been recognized that the bent profiled sheets permit the production of a cost-effective carrier profile which is reliable and flexible in use. In particular, it has been shown that the assembly along two connecting lines, at which the profiled sheets can be, for example, screwed or welded to one another, leads to a stable and low-distortion carrier profile. In addition, the cross-sectional shape of the carrier profiles can be significantly more easily adapted by suitable selection of the bending axes and bending angles in comparison to previously known square tube frames, the shape of which is predetermined by an extrusion process.

Moreover, in the case of square tube frames which are known from the prior art and are produced by an extrusion process, the retrospective production of fastening openings (such as in particular the bolt receptacles which are provided) is extremely complex. In contrast, the profiled sheets can be provided with a desired number of openings (for example bolt receptacles, fastening openings and/or access openings) before being assembled to form the hollow profile and preferably also before bending the profiled sheets. The profiled sheets can then be bent only in a subsequent step and assembled to form of the hollow profile. An access opening can be provided adjacent to a bolt receptacle.

The carrier profile can have at least one first force absorption region for absorbing a force flow exerted by the thick material distribution boom, wherein the boom pedestal is connected to the first force absorption region of the carrier profile by means of the tab elements. In addition, the frame can have a second force absorption region which is spaced apart from the first force absorption region in the longitudinal direction of the carrier profile and is provided for absorbing a force flow exerted by the thick material distribution boom, wherein the boom pedestal is connected to the second force absorption region of the carrier profile by means of a transverse carrier. The connection is preferably produced by a bolt connection. In this configuration, the force flow exerted by the thick material distribution boom can be divided between the two force absorption regions.

Furthermore, the carrier profile can have a force dissipation region which is spaced apart from the bolt receptacle in the longitudinal direction of the carrier profile and is provided to dissipate the force flow into an underlying surface, wherein the frame also has a supporting system which is connected to the carrier profile in the force dissipation region and is designed for introducing the forces, which are transmitted by the carrier profile (13), into the underlying surface.

The invention furthermore relates to a mobile thick material pump with a frame according to the invention, a thick material pumping device mounted on the frame, and a thick material distribution boom which is connected to the boom pedestal. The mobile thick material pump can be developed by further features described in conjunction with the frame according to the invention.

Further advantages and embodiments of the invention are apparent from the dependent claims, the description and the appended drawings.

It goes without saying that the features mentioned above and those which have yet to be explained below can be used not only in the respectively stated combination, but also in other combinations or on their own without departing from the scope of the present invention.

BRIEF DESCRIPTION OF THE DRAWINGS

The invention is illustrated on the basis of an exemplary embodiment in the drawings and is described in detail below with reference to the drawings.

DETAILED DESCRIPTION

Figure 1:
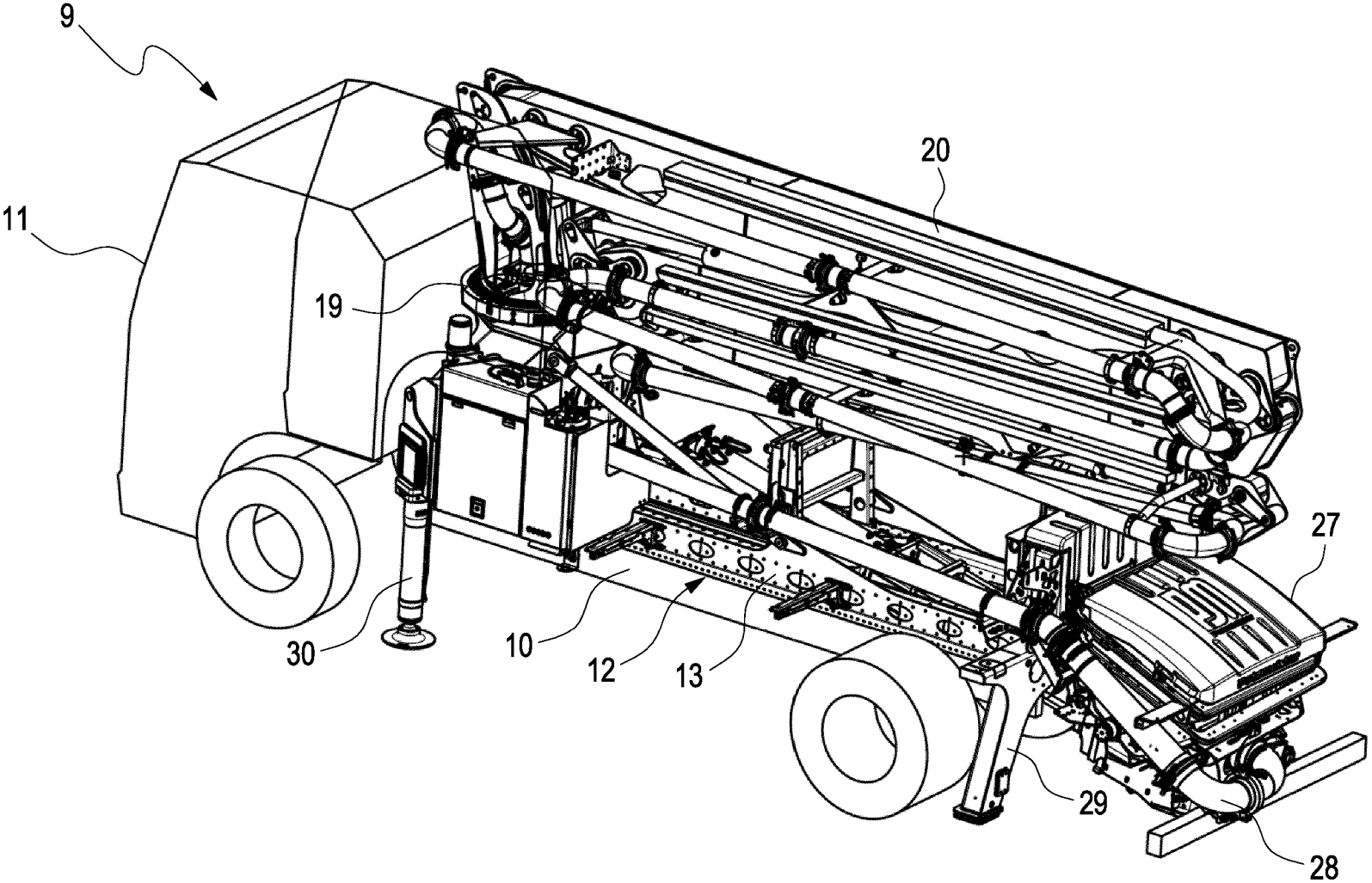
FIG. 1 shows a mobile thick matter pump according to the invention in a partially schematic three-dimensional view.

FIG. 1 shows a three-dimensional side view of a mobile thick matter pump 9 according to the invention with a motor-driven chassis 10, a driver's cab 11 and with a frame 12 according to the invention. The frame 12 is placed onto the chassis 10 and is fixedly connected thereto. The frame 12 has two carrier profiles 13 which run in the longitudinal direction of the frame and of which only one can be seen in FIG. 1.

Figure 2:
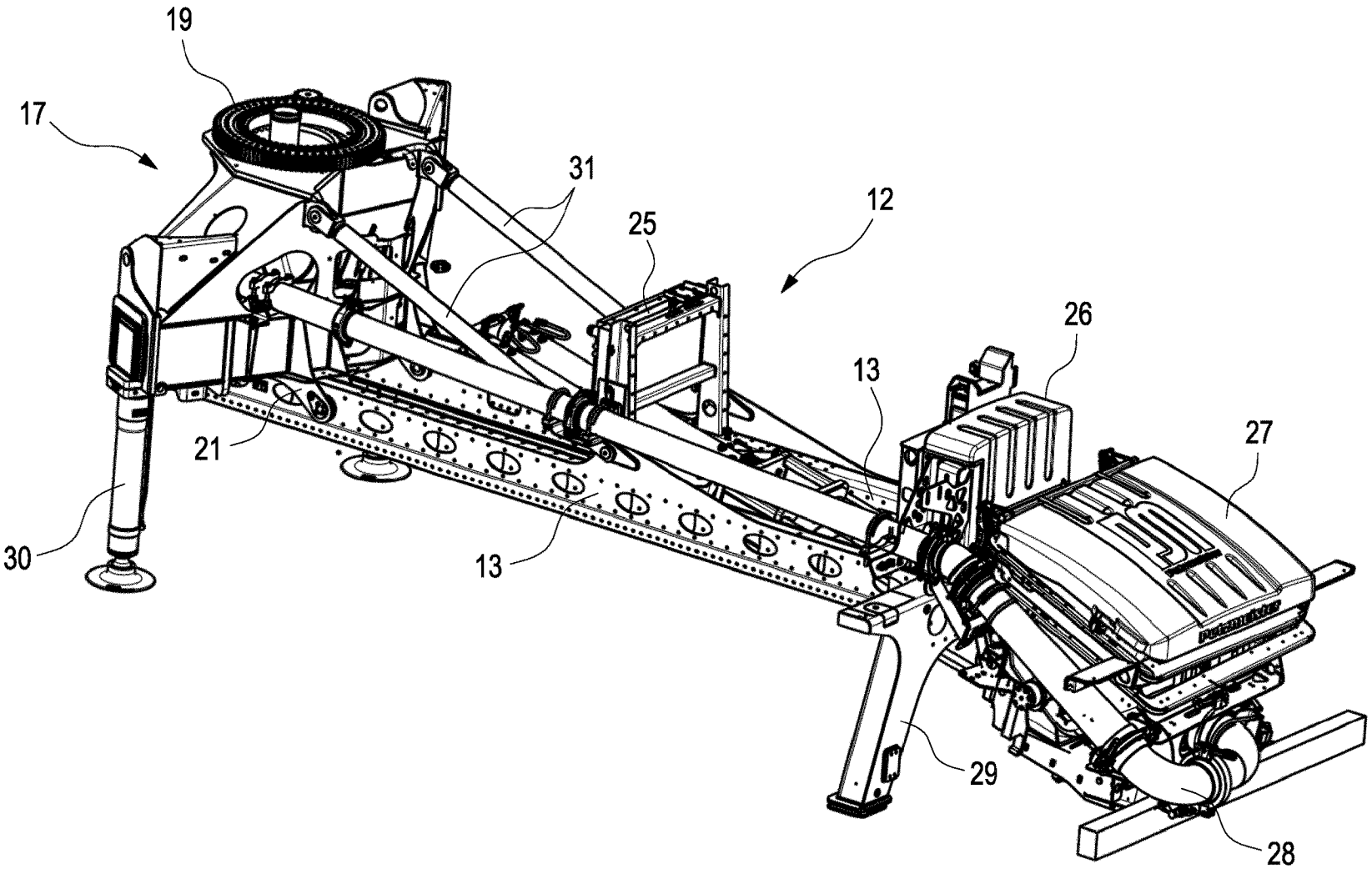
FIG. 2 shows the frame of FIG. 1 in a three-dimensional rearward view obliquely from above.
Figure 3:
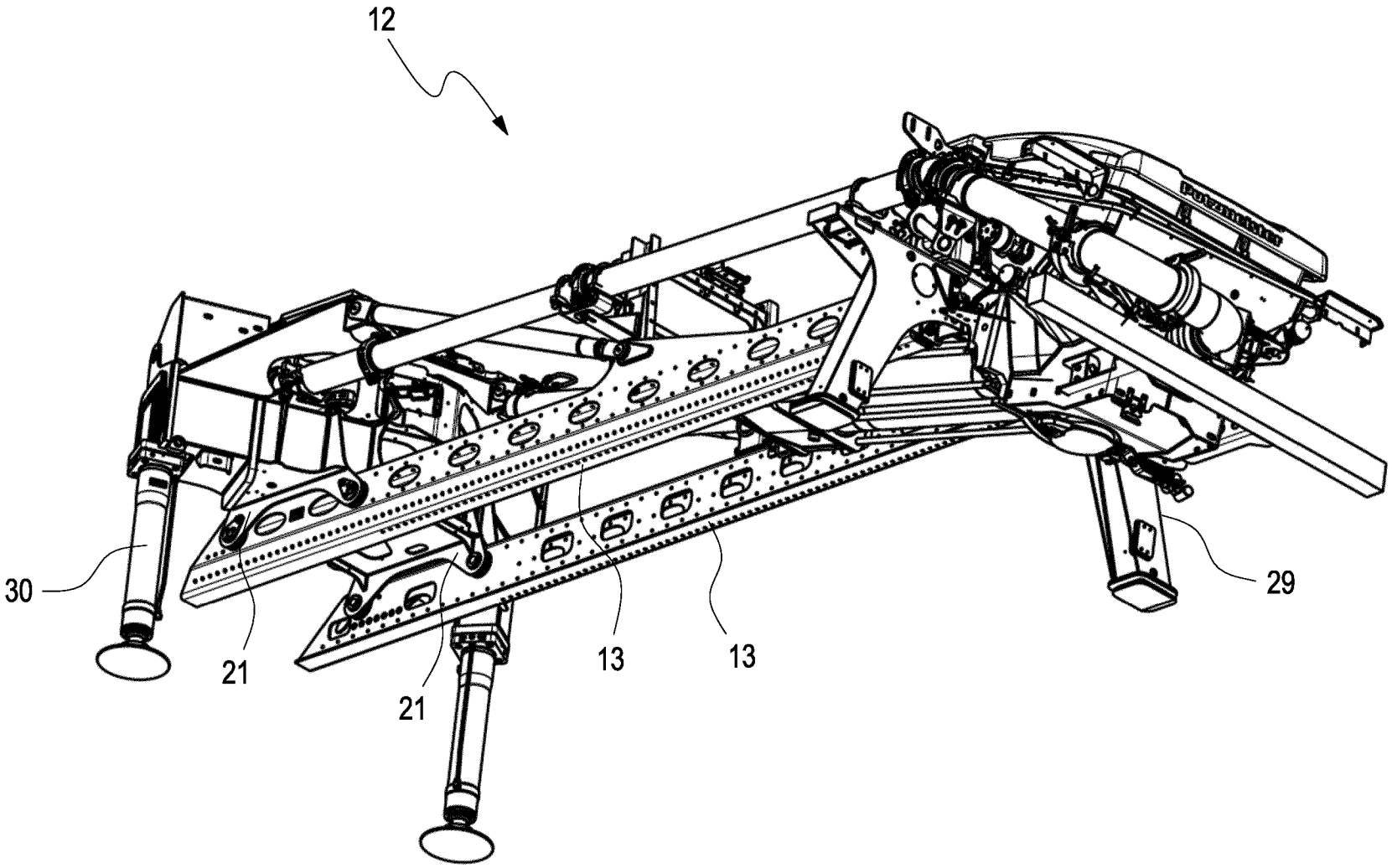
FIG. 3 shows the frame of FIG. 1 in a three-dimensional rearward view obliquely from below.

In a front region of the frame 12, as viewed in the longitudinal direction, there is a boom pedestal 17 which is fixedly connected to the carrier profiles 13 (also see FIGS. 2 and 3). In the upper region of the boom pedestal 17 there is a rotary bearing 19 on which an unfoldable thick matter distribution boom 20 is mounted rotatably about a vertical axis. In FIG. 1, the thick matter distribution boom 20 is in a folded state in which it is deposited on a central region, running in the longitudinal direction, of a loading surface of the mobile thick matter pump on two boom depositing pedestals 25, 26 (also see FIG. 2).

In the rear region of the frame 12 there is a thick matter feed container 27 and a thick matter pumping device located therebelow (not visible in the figure). A thick matter which is pressurized by the thick matter pumping device is conveyed via a pipeline 28 and further pipelines guided along the thick matter distribution boom 20 and can be discharged in this way at a desired location. In addition, the rear end of the frame 12 has a force dissipation region in which a supporting system 29 is located.

A substantial part of a force flow generated by the thick matter distribution boom 20 is conducted via the carrier profiles 13 to the supporting system 29 and dissipated there into the ground. In addition, the boom pedestal 17 is connected at the front end of the frame 12 to support legs 30 which likewise absorb part of the force flow and dissipate it into the ground.

Figure 5:
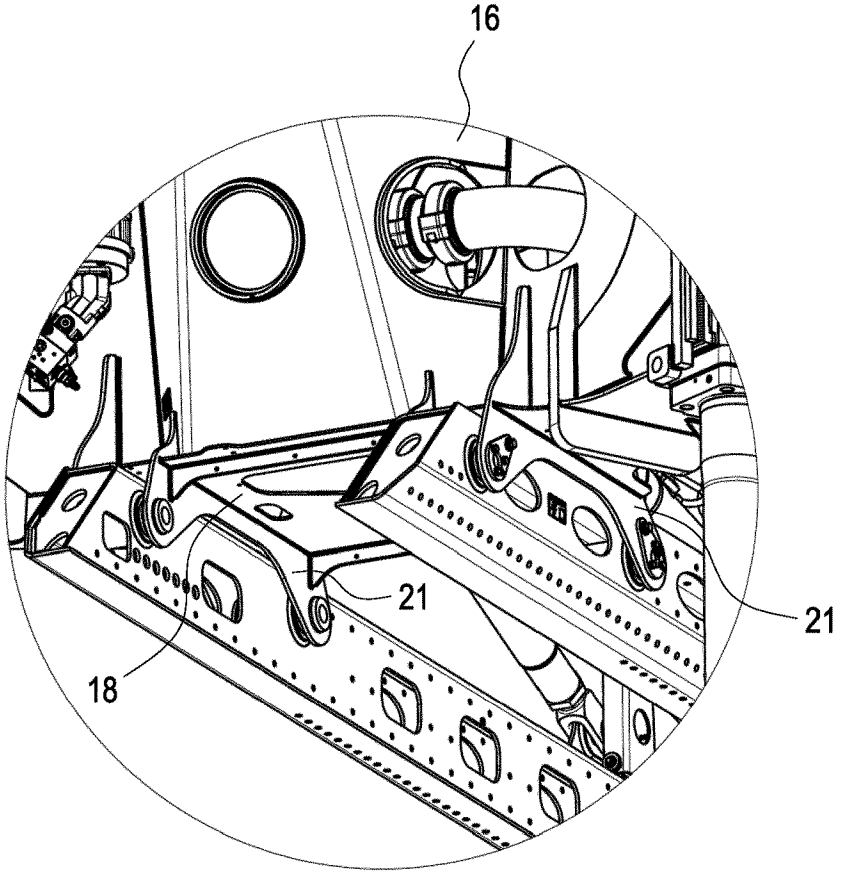
FIG. 5 shows an enlarged detail of FIG. 3.
Figure 4:
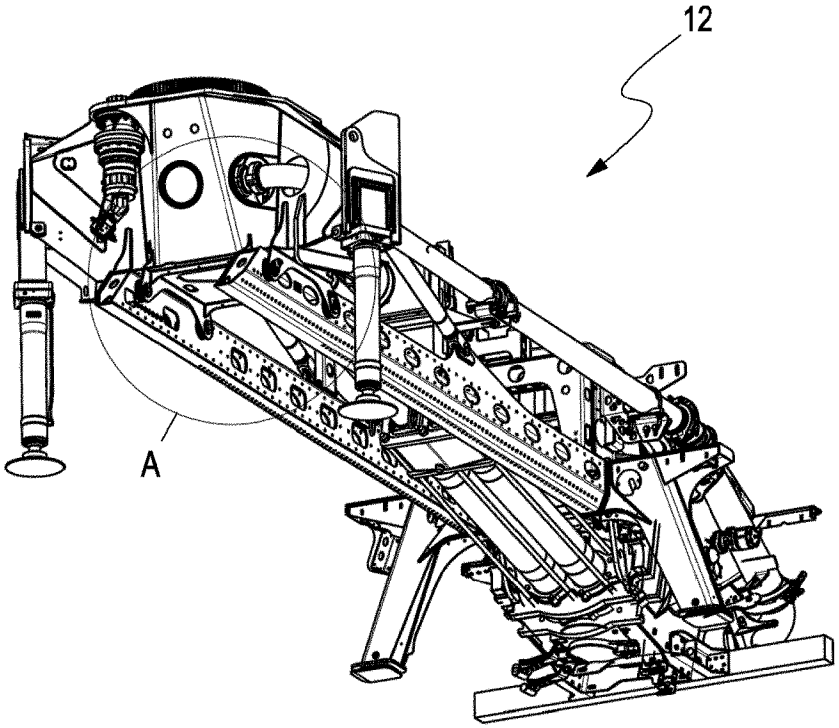
FIG. 4 shows the frame of FIG. 1 in a three-dimensional front-side view obliquely from below.

FIGS. 2 to 4 show the frame 12 of FIG. 1 in three-dimensional views and various perspectives. FIG. 5 shows a detail, indicated by a circle A in FIG. 4, in an enlarged view. The chassis, the driver's cab and the thick matter distribution boom have been omitted in these figures for better clarity. It can be seen in these views that the boom pedestal 17 is firstly connected to the carrier profiles 13 via transverse carriers 31. In addition, the boom pedestal 17 lies on the transverse carriers 13 in a front region thereof and is connected to the carrier profile 13 by means of a bolt connection. In particular, FIGS. 3 to 5 show a tab 21 which is arranged on the left side of the carrier profile 13 in the direction of travel and is part of the bolt connection. The configuration of the bolt connection will be explained in detail in conjunction with FIGS. 6 to 8.

Figure 6:
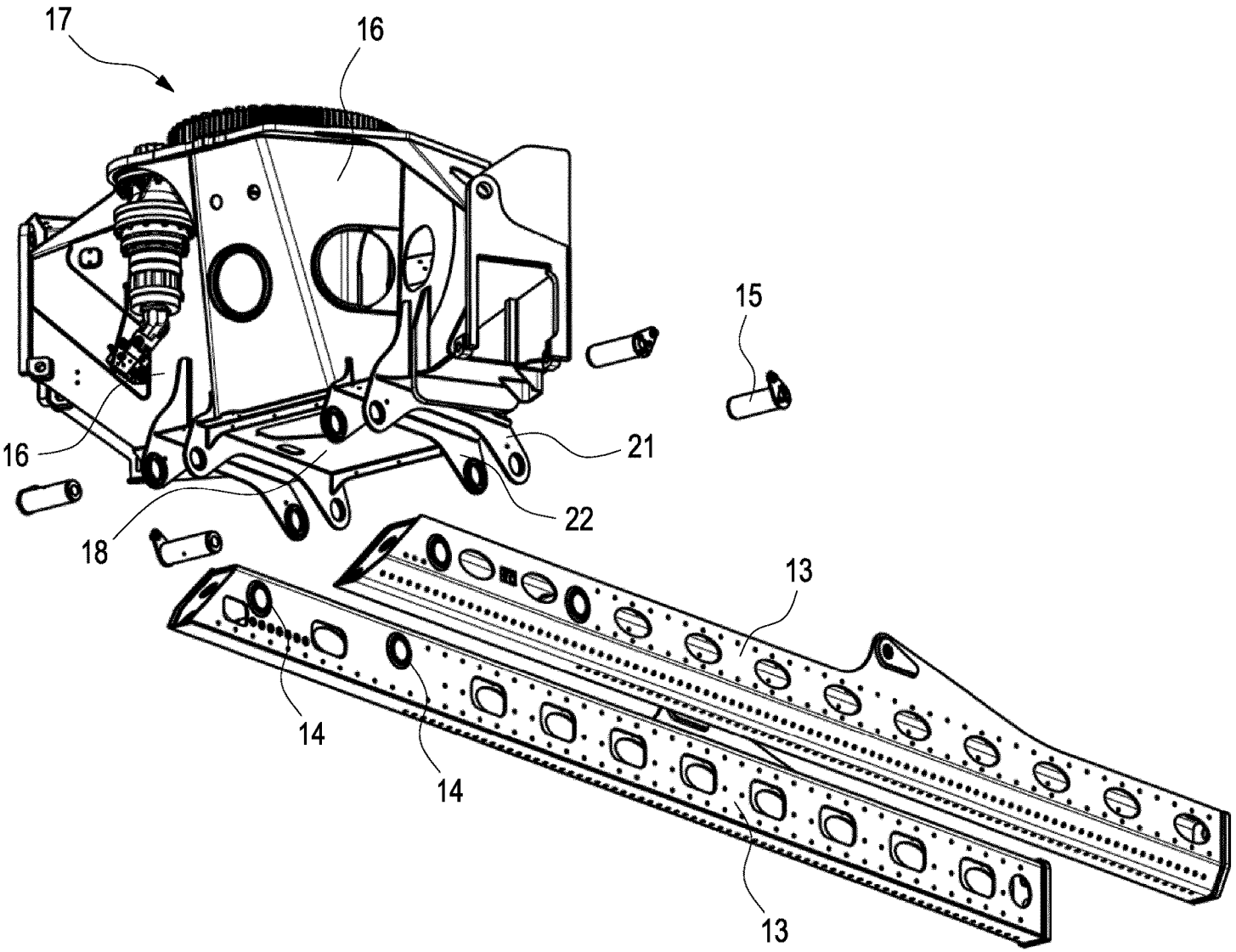
FIG. 6 shows parts of the frame of FIG. 1 in an exploded illustration.
Figure 8:
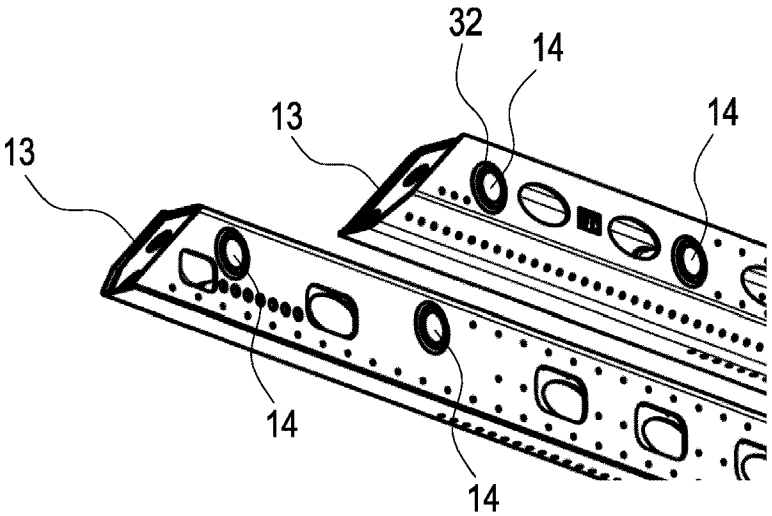
FIG. 8 shows the carrier profiles shown in FIG. 6, in an enlarged view.
Figure 7:
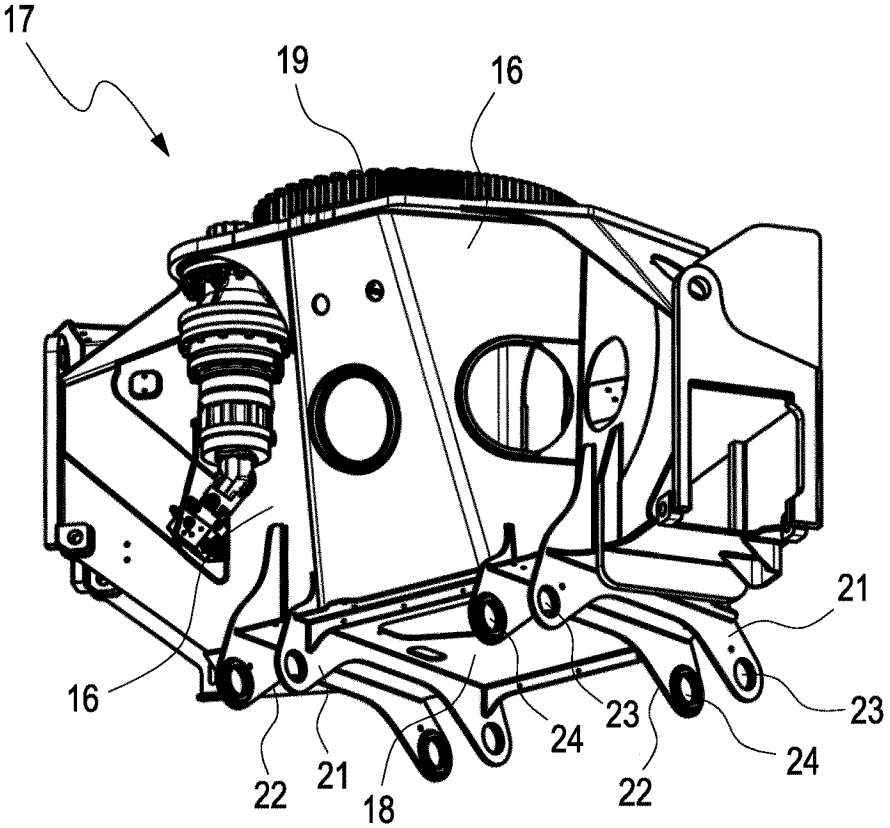
FIG. 7 shows the boom pedestal of FIG. 6 in an enlarged view.

FIG. 6 shows parts of the frame 12 of FIG. 1 in an exploded illustration. In particular, the boom pedestal 17 and the two profile carriers 13 are shown in this view. FIGS. 7 and 8 respectively show the boom pedestal 17 and part of the carrier profiles 13 in an enlarged view. It can be seen in these views that there is a further tab 22 on the right side of the carrier profile 13, as viewed in the direction of travel. Tabs 21, 22 are formed from sheet metal parts which are welded along connecting lines partly to a side surface portion 16 of the boom pedestal 17 and partly to a base surface portion 18 of the boom pedestal 17. The tabs 21, 22 are oriented approximately parallel to side walls of the carrier profile 13. In addition, the tabs 21, 22 are arranged at a distance from one another, the distance corresponding to the cross-sectional width of the carrier profile 13. When the boom pedestal 17 is placed thereon, the tabs 21, 22 therefore enclose the carrier profile 13 between them such that the tabs 21, 22 come to lie next to the side walls.

The tab 21 has a front through hole 23 and a rear through hole 23. The tab 22 likewise has a front through hole 24 and a rear through hole 24. The through holes 23, 24 of the adjacent tabs 21, 22 are aligned with one another. When the boom pedestal 17 is placed onto the carrier profile 13, the through holes 23, 24 are also aligned with a bolt receptacle 14 leading through the carrier profile 13. After the boom pedestal 17 is placed onto the carrier profiles 13, a bolt element 15 can be correspondingly guided through the through hole 23 of the left tab 21, through the bolt receptacle 14 and through the through hole 24 of the right tab 22. A cylinder sleeve which receives the bolt element is inserted into the bolt receptacle 14. This is explained in detail with reference to FIGS. 9 and 10.

Figure 10:
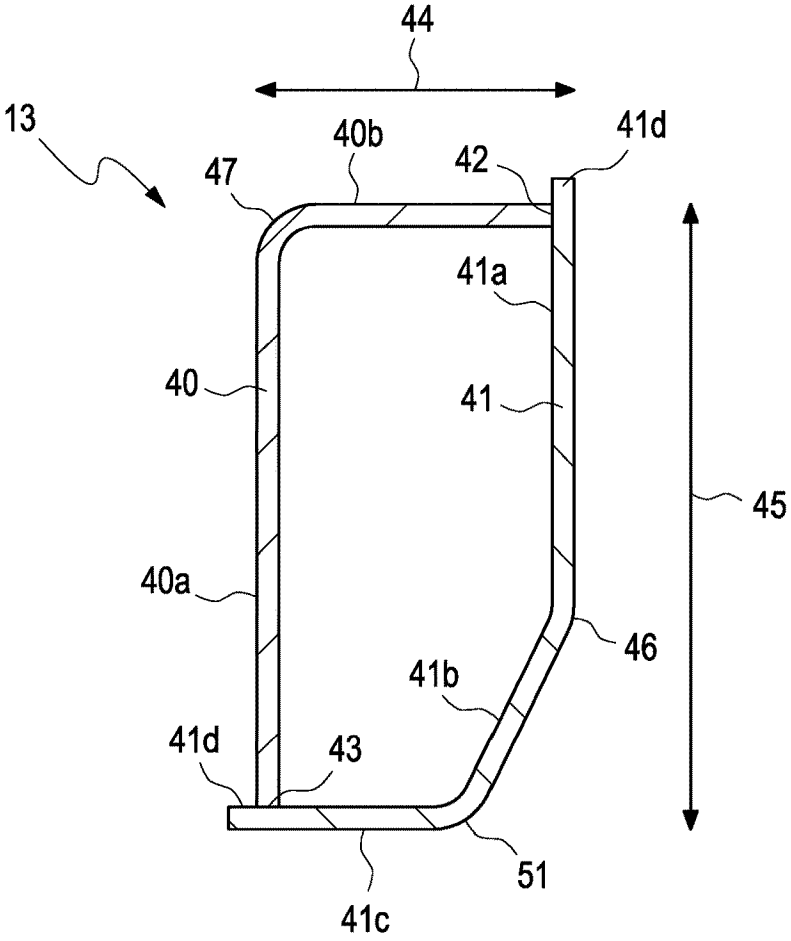
FIG. 10 shows a cross-sectional view of the carrier profile of FIG. 9.
Figure 9:
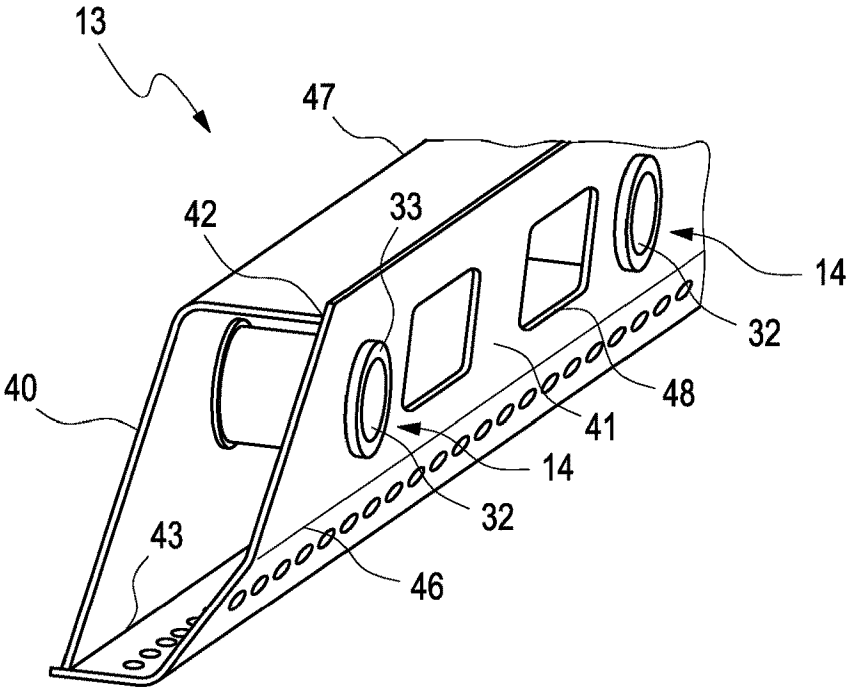
FIG. 9 shows a three-dimensional, enlarged side view of part of the carrier profile of FIG. 8.

FIG. 9 shows a three-dimensional enlarged side view of part of the carrier profile 13 used in the embodiment of FIG. 1. FIG. 10 shows the carrier profile of FIG. 9 in a cross-sectional view. It can be seen in the views of FIGS. 9 and 10 that the carrier profile 13 comprises two profiled sheets 40, 41 which are assembled to form a hollow profile by being welded to one another along two connecting lines 42, 43. This produces a hollow profile with a cross-sectional width 44 of approximately 20 cm and a cross-sectional height 45 of approximately 40 cm. The profiled sheet 41 has protrusions of approximately 2 cm which project beyond the connecting lines 42, 43 and are not counted toward the cross-sectional width 44 or cross-sectional height 45.

The profiled sheet 40 is bent by approximately 90° around a bending axis 47 such that the profiled sheet 40 has two partial portions 40*a*, 40*b* which are separated from one another by the bending axis 47 and are at a 90° angle to one another. The profiled sheet 41 is bent by in each case approximately 45° around two bending axes 46, 51 such that it has three partial portions 41*a*, 41*b* and 41*c* which are separated from one another by the bending axes 46, 51. The partial portions 40*a* and 41*a* are side walls of the carrier profile 13 within the meaning of the present description.

Portions 41*a* and 41*c* which are each located at the edge of the profiled sheet 41 and the portions 40*a* and 40*b* of the profiled sheet 40 are at an angle of approximately 90° to one another. In addition, the connecting lines 42, 43 lie diagonally opposite in a fictitious rectangle formed by the cross-sectional width 44 and the cross-sectional height 45.

It has been shown that a reliable and stable welded joint can be produced with profiled sheets perpendicular to one another and when the aforementioned protrusion is used. In addition, component distortion arising due to heat during the welding can be virtually completely avoided because of the symmetrical arrangement of the connecting lines, and therefore no retrospective straightening of the carrier profile 13 is necessary.

The partial portion 41*c* of the profiled sheet 41, which partial portion forms a bottom side of the carrier profile 13, has a width which is smaller than the maximum cross-sectional width 44 of the carrier profile 13. This leads to the carrier profile 13 taking up a smaller construction space in the lower region. Selection of the bending axes 46, 51 causes an increase in the cross section of the carrier profile from the bottom side in the direction of the top side until it reaches the overall maximum cross-sectional width 44 level with the bending axis 46. By means of this cross-sectional increase, construction space in the upper region of the carrier profile 13, which construction space is frequently dimensioned less concisely, can be better used and the stability of the carrier profile 13 thus increased.

By means of the above-described embodiment of the profiled sheet 41 with three partial portions 41*a*, 41*b*, 41*c* at an angle to one another, despite a large cross section in the upper region of the carrier profile 13 a clearance, for example for chassis parts (such as protruding spring brackets) or wing holders can be permitted in the lower region, with good accessibility also being ensured in the event of servicing. In addition, by means of the oblique partial portion 41*b*, which is angled by approximately 45° with respect to the partial portions 41*a* and 41*c*, comparison to other types of cutouts (for example a cutout angled by 90°) a harmonious force flow in respect of the cross-sectional values (geometrical moment of inertia, bending, torsion and shear flow) is made possible while simultaneously making the greatest possible use of the construction space.

Figure 11:
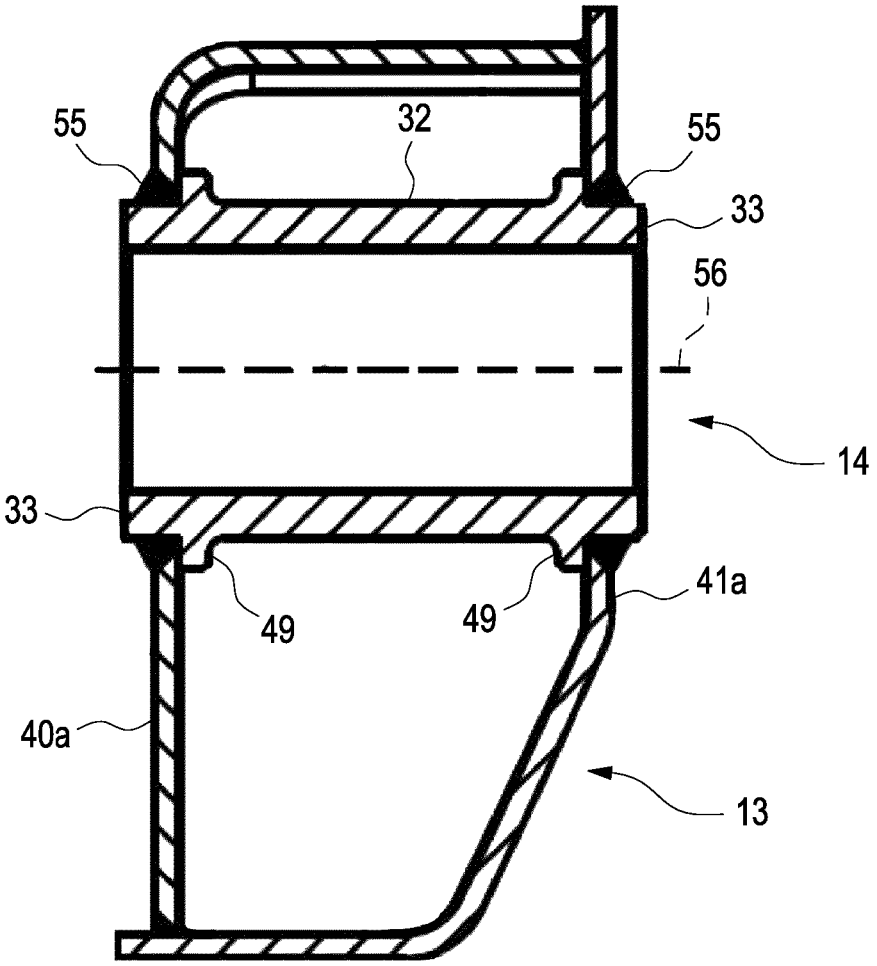
FIG. 11 shows a further cross-sectional view of the carrier profile of FIG. 9 along a different sectional plane with a cylinder sleeve inserted.

In addition, FIG. 9 shows the bolt receptacle 14 which has already been described in conjunction with FIG. 6, is arranged in the profiled sheet 41 and is brought into alignment with the through holes 23, 24 of the tab elements 21, 22 when the boom pedestal 17 is connected to the profile carriers 13. A bolt receptacle 14 can also be seen in FIG. 11 which shows a further cross-sectional view of the carrier profile 13 along a different sectional plane. It can be seen in FIGS. 9 and 10 that a cylinder sleeve 32 is inserted into the bolt receptacle 14. There is an access opening 48 next to the bolt receptacle 14. The cylinder sleeve 32 has portions 33 which project along its axial direction (indicated by the dashed line 56 in FIG. 11) beyond the side walls 40*a*, 41*a* and are connected to the respective side wall 40*a*, 41*a* along a weld seam 55. In addition, the cylinder sleeve 32 has collars 49 which project outward from the cylinder surface and each lie against an inner surface of the respective side wall 40*a*, 41*a*. The position of the cylinder sleeve 32 along its axial direction 56 is determined by the collars 49; in addition, the collars 49 serve as a weld pool retention device. This can be seen in particular in FIG. 11.

In addition, the cylinder sleeve 32 has an inner surface which corresponds to an outer surface of the bolt element 15. When the bolt element 15 is guided through the bolt receptacle 14, the outer surface of the bolt element 15 therefore lies tightly against the inner surface of the cylinder sleeve 32. The bolt elements 15 are therefore held stably in the cylinder sleeve. Consequently, the tab elements 21, 22 are fixed in a correspondingly stable manner to the profile carrier 13 in the connected state.

The invention claimed is:

1. A frame (12) comprising:

a boom pedestal (17) supporting a thick matter distribution boom (20); and a carrier profile (13) configured to receive and transmit a force flow generated by a weight force of the thick matter distribution boom (20), wherein the boom pedestal (17) has at least two tab elements (21, 22) which project downward from the boom pedestal (17), each of the at least two tab elements (21, 22) including a through hole (23, 24), the carrier profile (13) comprises a bolt receptacle (14) aligned with the through holes (23, 24), and wherein a bolt element (15) extends through the through holes (23, 24) and the bolt receptacle (14), connecting the boom pedestal (17) to the carrier profile (13).

2. The frame (12) of claim 1, wherein each of the at least two tab elements (21, 22) are formed from a sheet metal part oriented parallel to a side surface of the carrier profile (13).

3. The frame (12) of claim 1, wherein the at least two tab elements (21, 22) are oriented along a longitudinal direction of the carrier profile (13).

4. The frame (12) of claim 1, wherein the at least two tab elements (21, 22) engage laterally around the carrier profile (13) in a transverse direction.

5. The frame (12) of claim 1, wherein the carrier profile (13) is in the form of a hollow profile, wherein preferably one of the at least two tab elements (21) is oriented parallel to a first side wall (41*a*) of the hollow profile and the other of the at least two tab elements (22) is oriented parallel to a second side wall (40*a*) of the hollow profile.

6. The frame (12) of claim 1, wherein the at least two tab elements (21, 22) are connected to the boom pedestal (17) by a joining connection.

7. The frame (12) of claim 6, wherein the boom pedestal (17) has at least one side surface portion (16), wherein at least part of the joining connection extends along the side surface portion (16).

8. The frame (12) of claim 6, wherein the boom pedestal (17) has a base surface portion (18), wherein at least part of the joining connection extends along the base surface portion (18).

9. The frame (12) of claim 1, wherein a cylinder sleeve (32) is inserted into the bolt receptacle (14), an inner surface of which cylinder sleeve corresponds to an outer surface of the bolt element (15).

10. The frame (12) of claim 9, wherein the cylinder sleeve (32) is fixedly connected to the carrier profile (13) by a joining connection.

11. The frame (12) of claim 9, wherein the cylinder sleeve (32) has an end-side collar (49) which projects outward from an outside surface of the cylinder sleeve and bears against an inner surface of a side wall (40*a*, 41*a*) of the carrier profile (13).

12. The frame (12) of claim 1, wherein the carrier profile (13) comprises at least two profiled sheets (40, 41) which are each bent along at least one bending axis (46, 47, 51) and are assembled along at least two connecting lines (42, 43) forming a hollow profile, wherein the connecting lines (42, 43) or the bending axes (46, 47, 51) are oriented parallel to a longitudinal direction of the carrier profile (13).

13. The frame (12) of claim 1, wherein the carrier profile (13) has at least one first force absorption region configured to absorb the force flow exerted by the thick matter distribution boom (20), wherein the boom pedestal (17) is connected to the first force absorption region of the carrier profile by means of the tab elements (21, 22), wherein the frame also has a second force absorption region which is spaced apart from the first force absorption region in a longitudinal direction of the carrier profile (13) and configured to absorb a force flow exerted by the thick matter distribution boom (20), wherein the boom pedestal (17) is connected to the second force absorption region of the carrier profile (13) by means of a transverse carrier (31), and wherein a connection between the transverse carrier (31) and the second force absorption region is produced by a bolt connection.

14. The frame (12) of claim 1, wherein the carrier profile has a force dissipation region which is spaced apart from the bolt receptacle (14) in a longitudinal direction of the carrier profile (13) and is provided for dissipating the force flow into an underlying surface, wherein the frame also has a supporting system (29) which is connected to the carrier profile (13) in the force dissipation region and is designed for introducing the forces, which are transmitted by the carrier profile (13), into the underlying surface.

15. A thick matter pump with a frame (12) of claim 1, comprising a thick matter pumping device mounted on the frame (12), and a thick matter distribution boom (20) which is connected to the boom pedestal (17).

16. The frame of claim 1, wherein the carrier profile (13) is a hollow profile extending in a longitudinal direction beneath the boom pedestal (17), said hollow profile including longitudinally extending side surfaces, the boom pedestal (17) is supported above the carrier profile (13) with the at least two tab elements (21, 22) adjacent the side surfaces and the bolt element (15) extending through the hollow carrier profile (13).

17. The frame of claim 1, comprising first and second longitudinally extending hollow carrier profiles (13) extending beneath the boom pedestal (17), each of said first and second hollow carrier profiles (13) including two bolt receptacles (14) extending through the hollow carrier profile (13) at longitudinally spaced locations along the hollow carrier profiles (13), said at least two tab elements comprise a tab element (21, 22) having through holes (23, 24) aligned with each of the bolt receptacles (14), wherein one bolt element (15) extends through the through holes (23, 24) and the hollow carrier profile (13) at each of the bolt receptacles (14), said bolt elements (15) oriented transverse to the longitudinal extending hollow carrier profiles (13).

18. The frame of claim 1, wherein the carrier profile (13) is a hollow profile and the bolt receptacle (14) includes an opening in a first side wall (41*a*) and an opening in a second side wall (40*a*) of the hollow profile, allowing the bolt element (15) to extend through the hollow profile to connect the tab elements (21, 22) to the carrier profile (13).

* * * * *